US006820768B2

(12) United States Patent
Belanger

(10) Patent No.: US 6,820,768 B2
(45) Date of Patent: Nov. 23, 2004

(54) ELONGATE HAND HELD GLUE GUN

(75) Inventor: Richard A. Belanger, Kensington, NH (US)

(73) Assignee: Adhesive Technologies, Inc., Hampton, NH (US)

( * ) Notice: Subject to any disclaimer, the term of this patent is extended or adjusted under 35 U.S.C. 154(b) by 0 days.

(21) Appl. No.: 10/347,358

(22) Filed: Jan. 21, 2003

(65) Prior Publication Data

US 2003/0150875 A1 Aug. 14, 2003

Related U.S. Application Data

(60) Provisional application No. 60/350,949, filed on Jan. 25, 2002.

(51) Int. Cl.[7] ..... B67D 5/62
(52) U.S. Cl. ..... 222/146.5; 222/325; 222/391
(58) Field of Search ..... 222/325, 146.5, 222/391

(56) References Cited

U.S. PATENT DOCUMENTS 4,776,490 A * 10/1988 Wingert ..... 222/146.5
4,826,049 A * 5/1989 Speer ..... 222/146.5
5,549,178 A * 8/1996 Yuhas ..... 184/106
5,686,811 A * 11/1997 Bushong et al. ..... 320/110

* cited by examiner

*Primary Examiner*—Philippe Derakshani
(74) *Attorney, Agent, or Firm*—Clark & Brody

(57) ABSTRACT

A hand held hot melt glue gun has an elongate body portion that is easily held in a user's palm for accurate placement of the glue. The body forms a heat chamber that lies in the body parallel to the longitudinal axis of the body. A trigger mechanism operates by motion transverse to the longitudinal axis of the body and includes an arm that extends from the trigger on one side of the heat chamber to an opposite side of the heat chamber to engage a gripper for advancing the glue.

11 Claims, 3 Drawing Sheets

ELONGATE HAND HELD GLUE GUN

CROSS REFERENCE TO RELATED APPLICATIONS

This application claims the benefit of U.S. Provisional Patent Application No. 60/350,949, which was filed on Jan. 25, 2002.

TECHNICAL FIELD

This invention relates to the art of hand held, hot melt glue guns.

BACKGROUND ART

Hand-held glue guns are known. Known glue guns often provide a handle and trigger formed in the shape of a pistol. Guns of this configuration are operated by directing the tip of the gun to the desired area with a motion very similar to that of aiming a pistol and then dispensing the glue by squeezing the trigger.

The method of using the prior glue gun is generally imprecise, which makes use of the prior structures difficult, particularly, for projects involving small features or requiring precision.

SUMMARY OF THE INVENTION

In accordance with the invention, a hand held glue gun is provided with an elongate body portion, which lends itself to being held in the palm of the user's hand. A trigger lever is provided, which may be operated by the user's fingers when the body is so held in the user's palm. By this configuration, the glue gun of the invention may be held, for example, upright, in a generally vertical orientation with the dispensing nozzle facing upward or downward, for precise deposition of the glue. As well, the glue gun may be held as one would ordinarily hold a flashlight, with the body in the palm and the fingers on the trigger lever and the nozzle facing forward, or with the body engaged by the fingers and the trigger lever operated by the thumb, or in other orientations.

A further advantage of the narrow configuration of the subject glue gun is that it may be used in a variety of situations where access is limited. For example, the glue gun of the invention lends itself to use in small spaces, for example, the interior of an audio speaker or an interior corner.

Because the body portion of the glue gun of the invention is elongate, the trigger lever and glue-stick feed mechanism are designed to accommodate a narrower, elongate configuration of the internal cavity. The trigger lever is pivotally attached to the body on one side of the heater cartridge or other heater element and includes an outer part that is shaped to engage the user's fingers or palm. An inner part is transverse to the body and extends to the opposite side of the heater cartridge. The inner part is preferably D-shaped and receives the cartridge in the interior opening of the inner part, but it may have other shapes, such as a U or J-shape as well.

The part of the inner element that extends to the opposite side of the heater cartridge pivotally receives a linkage to a glue stick gripping mechanism. Thus, when the user squeezes the glue gun, the trigger lever pulls on the linkage to advance the glue stick and dispense glue.

Another feature of the invention is a stand for holding the glue gun. The stand provides vertical support elements for holding the glue gun with the longitudinal axis of the body generally horizontal. The stand includes a non-stick glue pad that is located under the nozzle tip when the glue gun is in the stand to catch drips.

DETAILED DESCRIPTION OF THE PREFERRED EMBODIMENT

Figure 1:
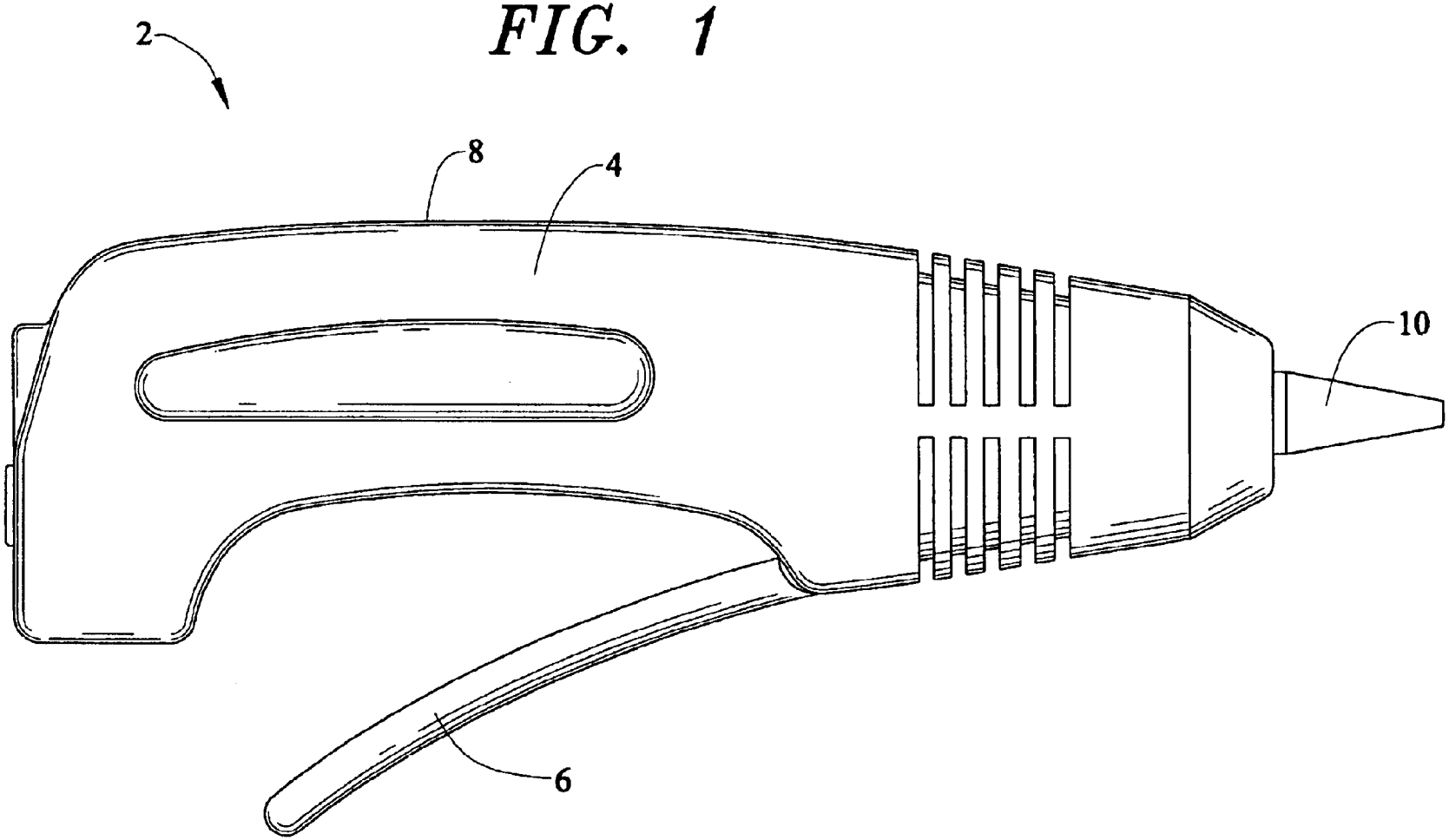
FIG. 1 is a side view of an elongate hand held glue gun in accordance with the invention.

With reference to FIG. 1, a preferred embodiment of the invention comprises a glue gun 2 with an elongate body 4 and a trigger lever 6. The elongate body has a contoured back surface 8 that fits comfortably in the palm of a user's hand. While the most likely orientation of the glue gun when the back surface 8 is in the user's palm is that the left end of the gun (when viewed as in FIG. 1) is adjacent the user's thumb, the opposite orientation is contemplated also.

When the back surface engages the user's palm, and the left end is adjacent the user's thumb, the glue gun can comfortably be held in a vertical orientation and the dispensing nozzle 10 aimed downward for precise dispensing of glue onto a horizontal surface. In this orientation, the user can easily operate the trigger lever with the fingers.

Figure 2:
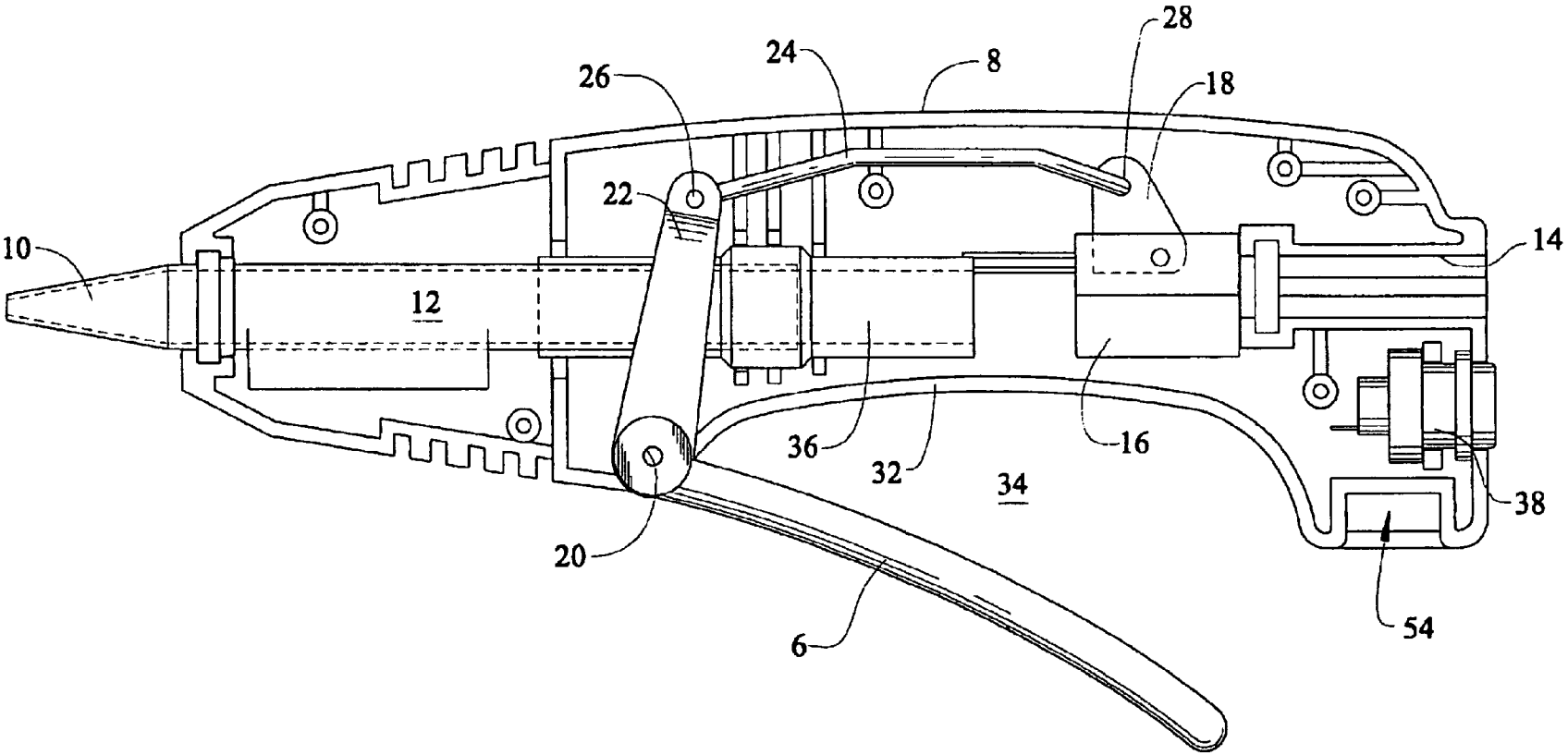
FIG. 2 is a longitudinal cross section of the glue gun shown in FIG. 1.

Referring to FIG. 2, the glue gun further includes a heat chamber 12 for receiving and heating a glue stick for dispensing from the nozzle 10. The heat chamber 12 lies within a cavity formed by the body 4 and may of any known construction. The heat chamber and body are similarly elongate, and the heat chamber extends in the general direction of the longitudinal axis of the body. A glue stick (not shown) is received through a channel 14 in the rear of the gun and is then received in a gripping mechanism 16, which is known in the art. The gripping mechanism 16 includes a pivotally mounted gripper 18, which pivots to engage the glue stick and then to advance the glue stick as the gripping mechanism is pulled forward.

The trigger lever 6 is pivotally mounted to the housing, as at 20, and an arm 22 is attached to the lever such that it rotates with the lever. A link 24 is pivotally connected between the arm, at a first connection 26, and the gripper, at a second connection 28. As the lever 6 is moved upward, the arm 22 rotates to pull the gripper 28 to the left of FIG. 2 and urge the glue stick into the heat chamber 12 to dispense glue from the nozzle 10.

Figure 3:
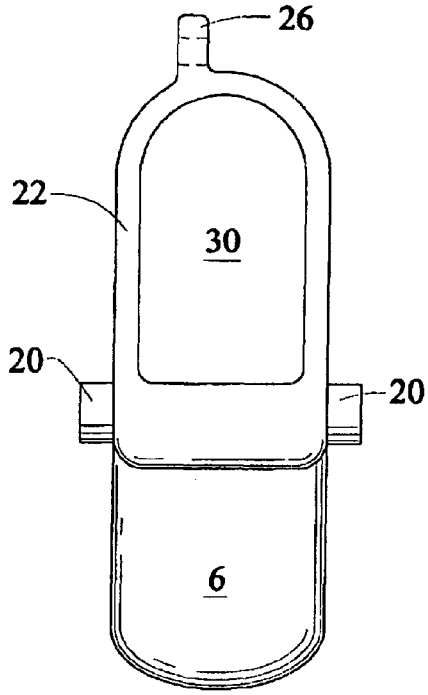
FIG. 3 is an end view of a preferred trigger mechanism.

FIG. 3 is an end view of a preferred embodiment of the trigger lever 6 and arm 22. The arm 22 provides an open area 30 through which the heat chamber passes, which allows the trigger lever 6 and link 24 to be located on opposite sides of the heat chamber. This construction facilitates arrangement of the parts in the elongate body 4. Thus, a surface 32 opposite the contoured back surface 8 forms a trigger cavity 34 that extends in the direction of the heat chamber 12. This allows the trigger lever 6 to move toward and away from the heat chamber, permitting the user to hold the glue gun in the several positions described above. The trigger lever and cavity 34 are also closer to the melt chamber than in prior designs, the surface 32 being immediately adjacent the input sleeve 36 of the heat chamber 12. It will be appreciated that the distance between the contoured back surface 8 and the surface 32 forming the trigger cavity is just greater than the diameter of the melt chamber and the height of the gripper 18. In a preferred embodiment, the distance from the centerline of the heat chamber to the surface 32 is 0.5 to 0.7 inch, and most preferably about 0.625 inch.

The heat chamber is preferably electrically powered, and a power cord receptacle 38 is provided for detachably receiving a power cord (not shown) that supplies electricity to the heat chamber. In the preferred embodiment, the removable power cord is of the two-prong type that is light in weight and easily detached and reattached. Because the power cord is easily detached, the user is able to remove the cord after the glue is heated and use the gun in a remote location for up to several minutes. This allows the user, for example, to use the gun for a small job on a ladder or in another remote location without using an extension cord or the inconvenience of an attached cord. In the preferred embodiment, the mass of the heating chamber is increased slightly to result in greater thermal inertia, which lengthens the time the gun may be used when unplugged.

Figure 4:
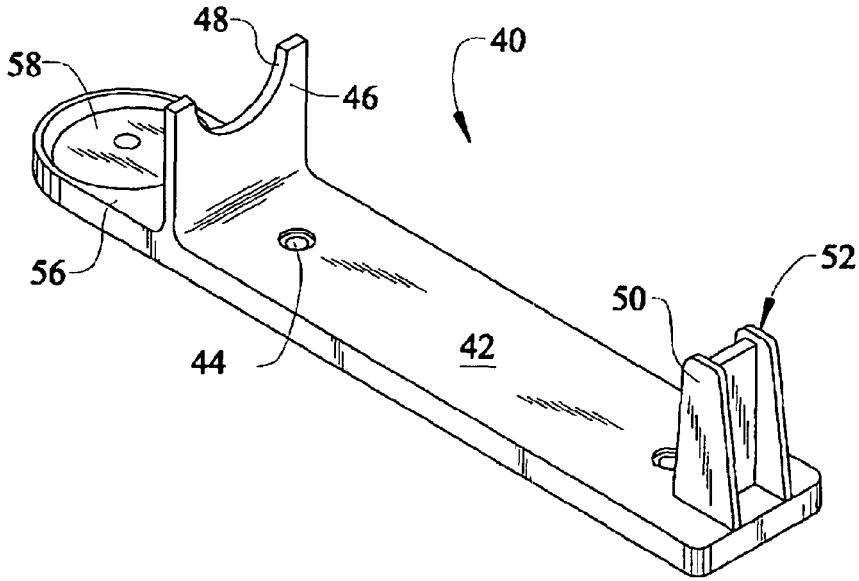
FIG. 4 is a perspective view of a stand for the glue gun of FIG. 1.

A further feature of the preferred embodiment of the invention is the stand 40 shown in FIG. 4, which is used to support the glue gun of FIG. 1 when not in use. The stand 40 includes a base portion 42, which can be secured to a worktable or the like by screws passing through holes 44. Upstanding from the base 42 are a forward support 46, having a curved surface 48 for engaging a forward part of the glue gun, and a rear support 50, that engages the rear part of the glue gun. The rear support 50 preferably includes an upper end 52 that is configured to engage a holder 54 in the rear of the glue gun. In the embodiment shown, the holder 54 is a rectangular cavity, and the upper end 52 is configured to fit in the cavity when the glue gun is placed on the holder.

The stand 4 further includes a drip tray 56 extending beyond the forward support 46 for catching any drips of glue from the nozzle 10 when the glue gun is on the stand. Preferably, a silicone pad 58 is placed in the drip tray, which permits easy cleaning because the glue does not stick to the silicone pad.

It will be appreciated that a unique glue gun and stand have been described. Modifications within the scope of the appended claims will be apparent to those of skill in the art.

What is claimed is:

1. A hot melt glue gun comprising an elongate body extending along a longitudinal axis and forming an interior cavity, a heat chamber in said cavity extending generally along said axis and configured to accept glue stick moving into said chamber in a direction paralled to said longitudinal axis, and a mechanism having an outer part configured to be engaged by a user to move said glue into said chamber, said outer part of said trigger mechanism being mounted to said body for motion transverse to said longitudinal axis.

2. A hot melt glue gun according to claim 1 further comprising a glue stick gripping mechanism configured to engage said glue and move in said direction parallel to said longitudinal axis wherein said trigger mechanism includes an arm that extends transversely from one side of said heat chamber to an opposed side and a link that extends along said cavity, wherein said link is connected to said arm at one end and to said glue stick gripping mechanism at the other.

3. A hot melt glue gun according to claim 2 wherein said arm is D-shaped to form an opening through which said heat chamber passes.

4. A hot melt glue gun according to claim 1 in further combination with a removable power cord.

5. A hot melt glue gun according to claim 1 in further combination with a stand, wherein said stand comprises a base, forward support means for engaging a forward part of said glue gun, and a rear support means for engaging a rear part of said glue gun.

6. A hot melt glue gun according to claim 5 wherein said rear support means comprises a rectangular end and said rear part of said glue gun includes a rectangular cavity for receiving said rectangular end.

7. A hot melt glue gun according to claim 5 wherein said stand includes a drip tray extending beyond said forward support.

8. A hot melt glue gun according to claim 7 wherein said drip tray includes a silicone pad therein.

9. A hot melt glue gun comprising an elongate body extending along a longitudinal axis and forming an interior cavity, a heat chamber in said cavity extending generally along said axis, and a trigger mechanism, said trigger mechanism being mounted to said body for motion transverse to said longitudinal axis, and further comprising a glue stick gripping mechanism wherein said trigger mechanism includes an arm that extends transversely from one side of said heat chamber to an opposed side and a link that extends along said cavity, wherein said link is connected to said arm at one end and to said glue stick gripping mechanism at the other.

10. A hot melt glue gun according to claim 9 wherein said arm is D-shaped to form an opening through which said heat chamber passes.

11. A hot melt glue gun comprising an elongate body extending along a longitudinal axis and forming an interior cavity, a heat chamber in said cavity extending generally along said axis and configured to accept a glue stick moving into said chamber in a direction parallel to said longitudinal axis, a glue stick feed mechanism mounted to move along said longitudinal axis, and trigger means for engaging the fingers of a user and moving said glue stick feed mechanism in said direction parallel to said longitudinal axis in response to movement of said fingers in a direction transverse to said longitudinal axis.

* * * * *